US006724320B2

(12) United States Patent
Basson et al.

(10) Patent No.: US 6,724,320 B2
(45) Date of Patent: Apr. 20, 2004

(54) SYSTEM AND METHOD FOR CONTROLLING A TRAFFIC LIGHT

(75) Inventors: Sara H. Basson, White Plains, NY (US); Dimitri Kanevsky, Ossining, NY (US); Wlodek W. Zadrozny, Tarrytown, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/901,409

(22) Filed: Jul. 9, 2001

(65) Prior Publication Data

US 2003/0006909 A1 Jan. 9, 2003

(51) Int. Cl.[7] ..... G08G 1/07
(52) U.S. Cl. ..... 340/906; 340/995.19; 340/995.2
(58) Field of Search ..... 340/902, 904, 340/906, 907, 924, 988, 990, 995, 994, 995.13, 995.19, 995.2; 701/200, 201, 213; 180/168

(56) References Cited

U.S. PATENT DOCUMENTS 4,361,202 A * 11/1982 Minovitch ..... 180/168
5,014,052 A * 5/1991 Obeck ..... 340/906
5,345,232 A * 9/1994 Robertson ..... 340/906
5,539,398 A * 7/1996 Hall et al. ..... 340/907
5,926,113 A * 7/1999 Jones et al. ..... 340/906
5,986,575 A * 11/1999 Jones et al. ..... 340/906
6,338,021 B1 * 1/2002 Yagyu et al. ..... 340/990

* cited by examiner

*Primary Examiner*—Van Trieu
(74) *Attorney, Agent, or Firm*—Louis J. Percello; Dilworth & Barrese, LLP

(57) ABSTRACT

There is provided a system and method for controlling at least one traffic light having a vehicle having a transmitter and a receiver for transmitting and receiving traffic control signals, and a control unit for processing traffic control signals; and a traffic control module having a transmitter and a receiver for transmitting and receiving traffic control signals, a control unit for processing traffic control signals, traffic light control logic for controlling the at least one traffic light, and means to connect to the at least one traffic light; wherein the traffic control signals control the flow of traffic about the at least one traffic light enabling a vehicle to travel from a present location to a destination passing through intersections at which traffic flow is controlled by the at least one traffic light; and also including means for controlling at least one traffic light on a selected optimal route in response to the traffic control signals.

19 Claims, 6 Drawing Sheets

SYSTEM AND METHOD FOR CONTROLLING A TRAFFIC LIGHT

BACKGROUND OF THE INVENTION

1. Field of the Invention

The present invention relates to a system and method for controlling a traffic light, and more particularly to a system and method for controlling traffic lights to enable faster response time for an emergency response vehicle (ERV) by generating traffic light control signals that control traffic lights along the response route of the ERV. The system can be localized to the ERV and the traffic light to be controlled, or the system can incorporate other systems such as a global positioning system (GPS) and/or traffic monitoring system (TMS), to aid in the traffic light control. Additionally, the system and method can be modified to incorporate multiple ERVs.

2. Description of the Related Art

Since the first electric traffic light was installed at a street intersection in Detroit, Mich., in 1920, the traffic light has become a most common device used to regulate the flow of traffic. Generally, traffic light systems rely on timers or vehicle sensors to control the cycle of the traffic light between its red and green stages, thus allowing different directions of traffic flow to enter into and pass through the intersection safely.

When responding to an emergency, emergency response vehicles (ERVs), such as police cars, fire trucks and ambulances, and their personnel, need to minimize the response time required to arrive at their destination. As a general rule, these ERVs are permitted to pass through an intersection against a traffic light to reduce their emergency response time. Often, though, a responding ERV must stop at an intersection to avoid collisions with other vehicles that enter the intersection. These other vehicles enter the intersection because the traffic light is green for their traveling direction and usually they do not observe the approaching ERV. This situation not only increases the response time of the ERV, but also creates a dangerous traffic situation.

Not only does traffic entering an intersection that an ERV is passing through create dangers and increase response time, the traffic might also completely prevent the ERV from entering into the intersection altogether. Motorists often have the habit of entering into an intersection when they cannot exit it. This phenomenon is referred to as gridlock. When gridlock occurs, response time can sky rocket. Unfortunately, for the ERV and the person in the emergency situation, the ERV cannot anticipate which route to take to avoid the least amount of gridlock and minimize response time. In addition to the gridlock situation, a similar situation of general traffic flow (or lack thereof) and traffic density along a response route can greatly increase response time.

There is therefore a need for a traffic light control system that decreases response time by anticipating a response route of an ERV. Such a system minimizes dangerous traffic conditions and gridlock, decreases the response time of an ERV, and increases the safety along a response route traveled by an ERV to its destination.

SUMMARY OF THE INVENTION

It is, therefore, an aspect of the present invention to provide a system and method for remotely controlling a traffic light.

It is another aspect of the present invention to provide a system and method for decreasing the response time of an ERV responding to an emergency by remotely controlling a traffic light.

It is a further aspect of the present invention to provide a system and method for anticipating a route from a present location of an ERV responding to an emergency to its destination, and controlling traffic lights along that route.

It is still a further aspect of the present invention to provide a system and method for determining a best route from a present location to a destination for an ERV responding to an emergency to travel and controlling traffic lights along the best route.

It is yet a farther aspect of the present invention to provide a system and method for controlling traffic lights for multiple ERVs traveling in the same vicinity.

The above aspects can be achieved by providing a system for controlling traffic lights, comprising a vehicle having a transmitter and a receiver for transmitting and receiving traffic control signals, and a control unit for processing said traffic control signals; and a traffic control module having a transmitter and a receiver for transmitting and receiving said traffic control signals, a control unit for processing said traffic control signals, traffic light control logic for controlling said at least one traffic light, and means to connect to said at least one traffic light; wherein said traffic control signals control the flow of traffic about said at least one traffic light enabling said vehicle to travel from a present location to a destination passing through intersections at which traffic flow is controlled by said at least one traffic light.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF THE PREFERRED EMBODIMENTS

Preferred embodiments of the present invention will be described herein below with reference to the accompanying drawings. In the following description, well-known functions or constructions are not described in detail since they would obscure the invention in unnecessary detail.

As an emergency response team, i.e., police, emergency medical technicians (EMTs), or fire personnel, is responding to an emergency, the team, traveling in an emergency response vehicle (ERV), must often travel through busy streets and intersections along its route to its destination, the scene of the emergency. Also, after leaving the emergency scene the ERV, particularly in the case of an ambulance, must transport those wounded at the scene to a further destination, for example, a hospital, again along busy streets and through busy intersections. During its travel along its response route, the ERV often encounters dangerous and often fatal, traffic situations. In order to minimize response time to its destination the ERV often travels at high speeds and enters intersections against a red light. Though the ERVs are often permitted by law to travel in this manner, other motorists on the roads along the route of the ERV do not always give the ERV the right-of-way. When a motorist is preoccupied or distracted by use of a cell phone, a loud car stereo, poor hearing or eyesight, or even loud traffic noises, the motorist might sometimes enter directly into the path of the responding ERV. This crossing of paths often occurs in traffic intersections, where the motorist usually has a green light signaling that he can enter "safely" into the intersection.

As mentioned prior, minimizing the response time for an ERV to respond to an emergency is a major concern of society. If the ERV gets stuck in traffic or gets into an accident along its response route, the response time can dramatically increase. This increase in response time could mean the difference between life and death for those injured at the emergency scene. By permitting the ERVs to travel at higher speeds and pass through intersections against the light, society attempts to minimize this response time, but often at the cost of safety.

It is therefore advantageous for society to have means to allow an ERV to safely enter into an intersection while reducing response time. By equipping an ERV with means to control a traffic light, the ERV can more safely and quickly respond to an emergency.

Figure 1:
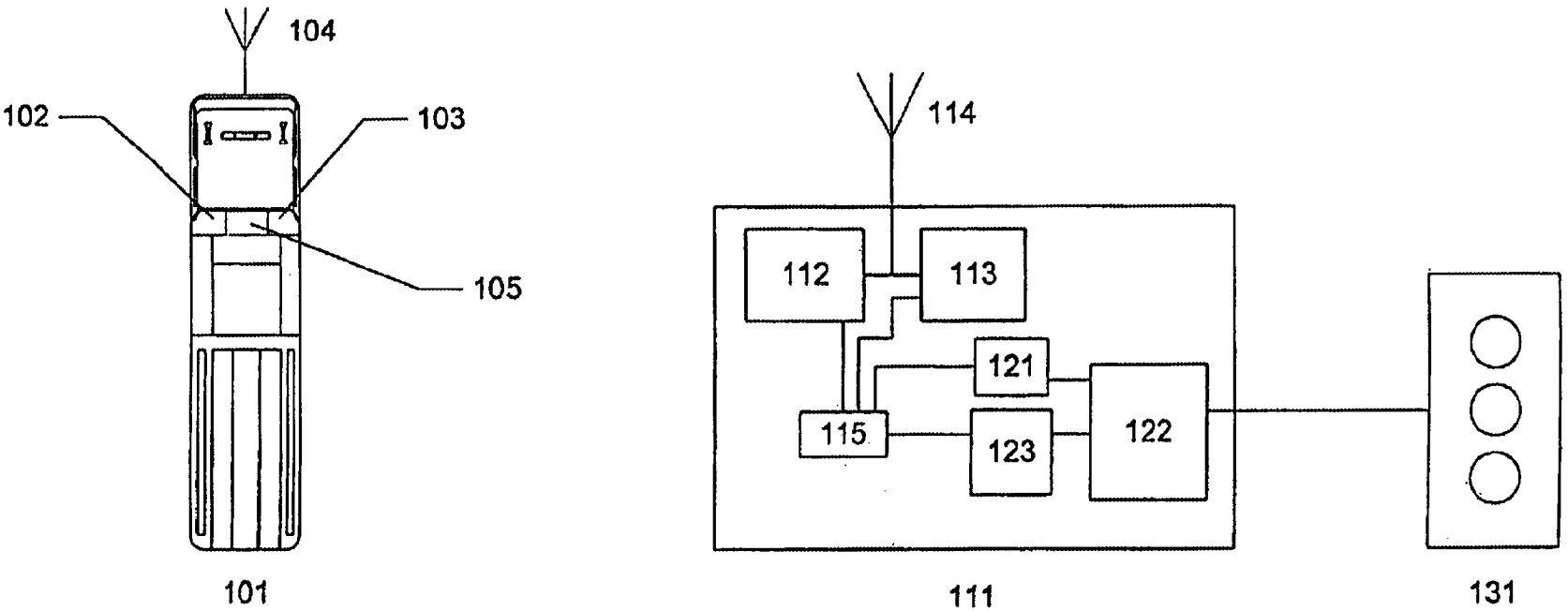
FIG. 1 is a block diagram illustrating a first embodiment of the present invention.

FIG. 1 is a block diagram illustrating a first embodiment of the present invention. As shown in FIG. 1, the first embodiment equips ERV 101 with transmitter 102 and receiver 103 for transmitting and receiving traffic control commands (TCCs) through antenna 104. ERV control unit 105 controls the overall operation of the ERV-section of the present invention. Also contained in ERV 101 is a time-out timer (not shown) for timing certain functions that will be described hereinafter with respect to FIG. 2. Also shown in FIG. 1 is traffic control module (TCM) 111 equipped with transmitter 112 and receiver 113 for receiving and transmitting the TCCs through antenna 114. Contained in TCM 111 is TCM control unit 115, traffic light control logic 123, security module 121 and bypass logic 122. The security module is for restricting access to the bypass logic 122 by unauthorized personnel. Also depicted in FIG. 1 is traffic light 131. The system transmitters, 102 and 112, and receivers, 103 and 113, can operate with radio frequencies, radar, optical signals, or any other available wireless communication means. Note that although TCM 111 is shown separate from traffic light 131, the actual location of the TCM and its components is not critical to the present invention. The present invention can be easily adapted for two-way, three-way, or multiple-way traffic lights as will become apparent during the operational description herein below.

Figure 2:
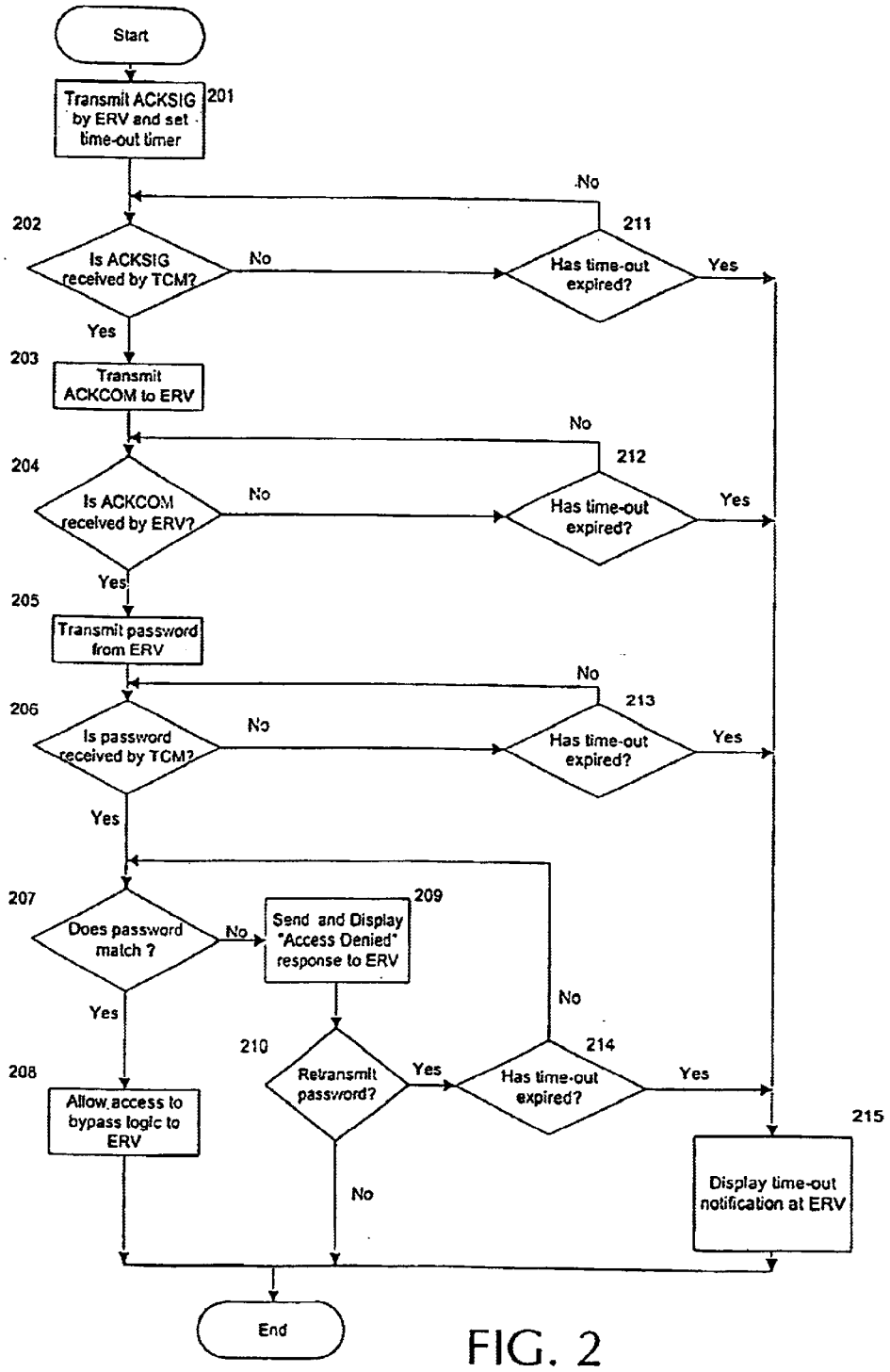
FIG. 2 is a flow chart describing an initialization process of the system according to the first embodiment of the present invention depicted in FIG. 1.

FIG. 2 is a flow chart describing an initialization process of the system according to the first embodiment of the present invention depicted in FIG. 1. The operation of the initialization process according to the first embodiment will now be described with respect to FIG. 1 and FIG. 2. The operation of the ERV-section of the present invention is under the control of ERV control unit 105. As ERV 101 approaches an intersection under control of traffic light 131, ERV 101 transmits an acknowledge signal (ACKSIG) in step 201 to first determine if the traffic light is controllable, i.e., whether the bypass logic 122 is contained in TCM 111. This is accomplished by transmitting from the ERV 101, either automatically or by an operator, the ACKSIG to TCM 111. When the ACKSIG is transmitted the time-out timer is set for a preset amount time. In the event that the time-out timer expires before the initialization process is complete, the system notifies the ERV personnel that the time remaining may be insufficient to process the bypass commands, and thus the ERV 101 should proceed to and through the intersection as if the traffic light is not under the control of the ERV 101. The system in step 202 determines if the ACKSIG is received by TCM 111. The overall control of TCM 111 is performed by the TCM control unit 115. If the ACKSIG is not received, the system checks the time-out timer in step 211. If the time-out timer has not expired, the system returns to step 202 to check if the ACKSIG is received. If the time-out timer has expired is step 211, the system in step 215 displays a time-out notification at the ERV 101 and ends the initialization process.

If the TCM 111 receives the ACKSIG, the TCM in step 203 transmits an acknowledge command (ACKCOM) signal back to the ERV 101. In step 204 the system checks if the ACKCOM is received by ERV 101 thus notifying the ERV personnel that the traffic light can be controlled. If the ACKCOM is not received, the system checks the time-out timer in step 212. If the time-out timer has not expired, the system returns to step 204 to check if the ACKCOM is received. If the time-out timer has expired is step 212, the system in step 215 displays a time-out notification at the ERV 101 and ends the initialization process.

If the ACKCOM is received by the ERV, in step 205 the ERV transmits a password to TCM 111. In step 206 the system checks if the password is received by TCM 111. If the password is not received, the system checks the time-out timer in step 213. If the time-out timer has not expired, the system returns to step 206 to check if the password is received. If the time-out timer has expired is step 213, the system in step 215 displays a time-out notification at the ERV 101 and ends the initialization process. If the password is received by TCM 111, the system checks if the received password matches a stored password in step 207. If the password does not match, the system in step 209 sends to and displays at the ERV 101 an access denied response, and requests in step 210 whether to resend the password. If the password is resent, the system checks the time-out timer in step 214. If the time-out timer has not expired, the system returns to step 207 to check if the password matches. If the time-out timer has expired is step 214, the system in step 215 displays a time-out notification at the ERV 101 and ends the initialization process. If in step 210 it is decided not to retransmit the password the initialization process ends. Finally, in step 208 if the password matches the stored password, access to the bypass logic is allowed and the initialization process ends. These initial steps in the process eliminates any confusion on the part of the ERV personnel as to whether the light can be controlled, and thus on how to proceed into the intersection. During the initialization process, traffic light 131 remains under the control of the traffic light control logic 123.

Figure 3:
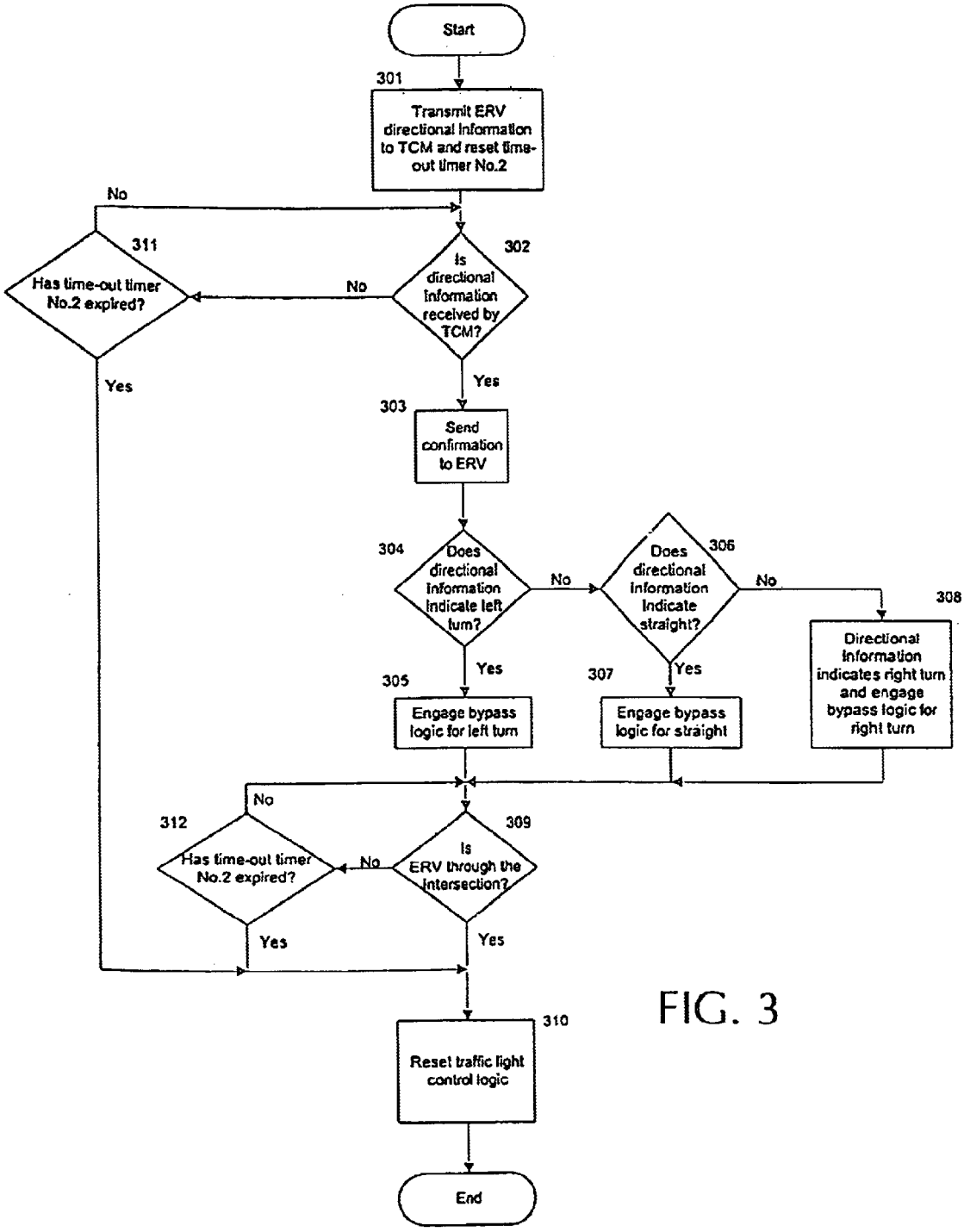
FIG. 3 is a flow chart describing the traffic light control process according to the first embodiment of the present invention.

FIG. 3 is a flow chart describing the traffic light control process according to the first embodiment of the present invention. In step 301 ERV 101 transmits directional information (DIRINFO) to TCM 111 and a second time-out timer (time-out timer No. 2) is reset. The to DIRINFO is a signal sent from ERV 101 telling TCM 111 which direction the ERV 101 will travel through the intersection, i.e., left, straight, or right. Time-out timer No. 2 is used as a back-up for resetting the normal traffic light logic. Time-out timer No. 2 is set to a time that it would normally take for ERV 101 to complete its pass through the intersection, plus a safety margin of additional time. Next, in step 302, it is determined if the DIRINFO is received by the TCM 111. If the DIRINFO is not received the process in step 311 determines if time-out timer No. 2 has expired. If not the system returns to step 302. If the timer has expired the system proceeds to step 310 and resets the traffic control logic to a normal operating mode and the system ends. If the DIRINFO is received a confirmation signal is sent to ERV 101 in step 303.

Next TCM 111 determines in step 304 whether the DIRINFO contains left turn information. If it does, the bypass logic for a left turn is engaged in step 305. If it is not left turn information, the system goes to step 306 to determine if it is straight information. If it is, the system in step 307 engages the bypass logic for straight. If it is not straight, the system in step 308 determines, by default, that the DIRINFO contains a right turn command, and in step 308 the system engages the right turn bypass logic. After one of the bypass logic is engaged, the system in step 309 determines if the ERV is through the intersection. This can be accomplished in several ways. For example, ERV 101 might send a signal confirming pass-through of the intersection, or the system might utilize time-out timer No. 2, or TCM 111 can contain circuitry to determine signal strength of a test signal transmitted from ERV 101 and based on signal strength determine if ERV 101 has cleared the intersection. Whichever method is used, if no determination is made, the system in step 312 checks time-out timer No. 2. If time-out timer No. 2 has not expired the system returns to step 309. If it has expired the system in step 310 resets the traffic light logic to normal operation and ends the process. If the system in step 309 does receive a confirmation that ERV 101 is through the intersection in step 309, the system goes to step 310 and resets the traffic light control logic to normal operation and ends the process.

While the first embodiment describes a system wherein an ERV communicates with an individual TCM, the second embodiment will describe a system wherein an ERV communicates with not only a TCM, but a system comprising an ERV, at least one TCM, means for determining position and direction of the ERV, and means for detecting traffic flow patterns.

Figure 4:
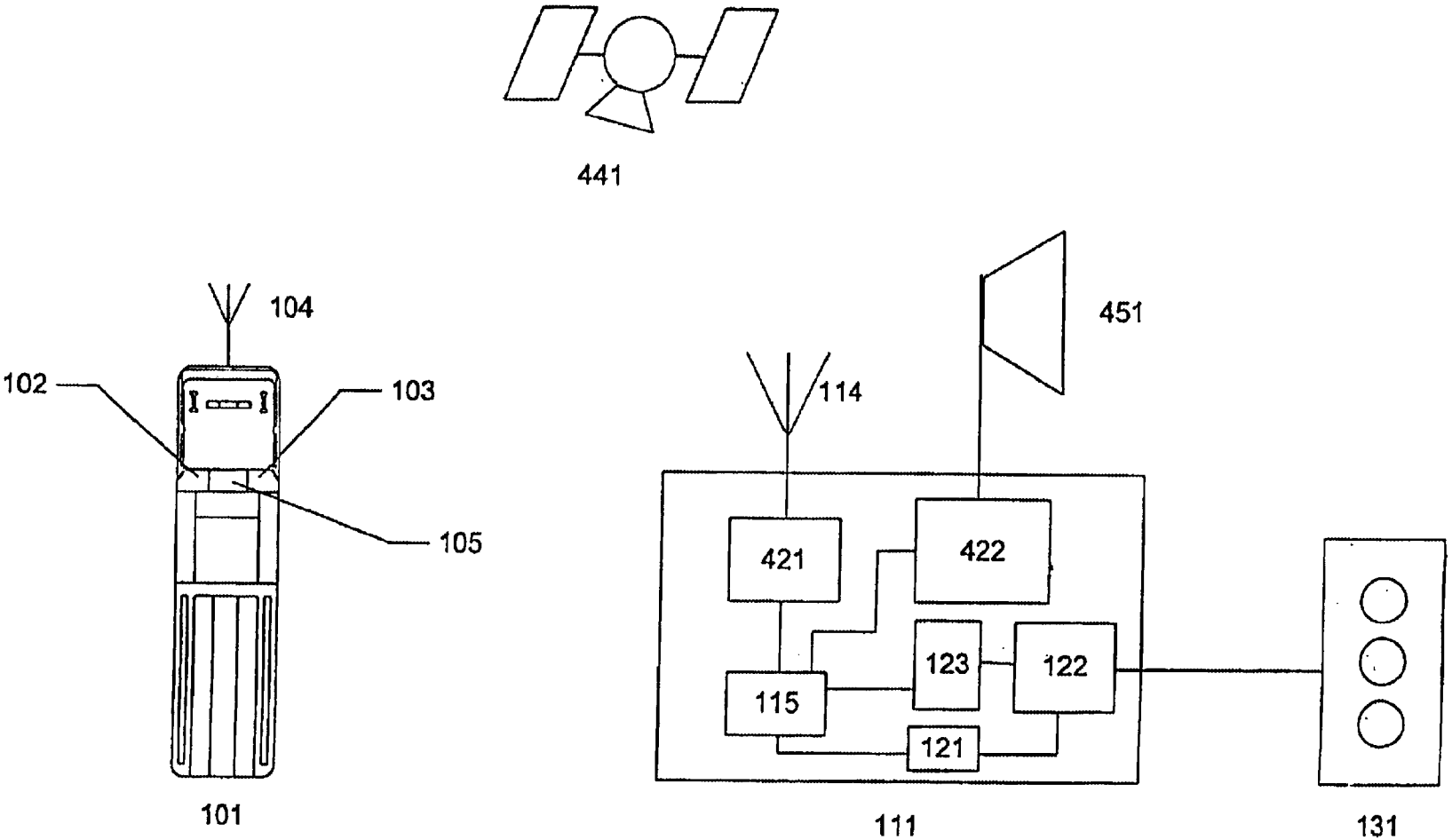
FIG. 4 is a diagram representing a second embodiment of the present invention.

FIG. 4 is a diagram representing the second embodiment of the present invention. In addition to the elements depicted in FIG. 1, shown in FIG. 4 are global positioning system (GPS) 441 for determining the position of ERV 101, traffic detector 451 for detecting the amount of cars on the streets connecting to various intersections, and traffic control module 422 for analyzing data received from traffic detector 451. Also, transmitter 112 and receiver 113 have been replaced by communication module 421. Communication module 421 still contains the equipment necessary to communicate with ERV 101, but also contains communication equipment to communicate with the GPS 441 and other TCMs. This communication can take place via radio waves, cellular channels, an intranet, or the Internet. Also, for greater overall system control, all of the TCMs can be connected to a central processing station (CPS). The CPS can also coordinate the traffic lights and the flow of traffic in a situation where there are multiple ERVs traveling in the same vicinity. The CPS might be manned or unmanned depending on the requirements of the system. In the preferred embodiment and referring again to FIG. 4, control unit 115 contains a map database (not shown) for providing area street maps to direct ERV 101, and a routing decision module (not shown) for performing best route calculations, which will be discussed below in greater detail.

In the preferred second embodiment, traffic detector 451 is a radar system, but any means for detecting the flow of traffic near an intersection can be utilized. A simple method of determining the flow of traffic is to determine the density of cars on a street that can be measured as a ratio of the number of cars located on the street to the length or area of the street. A more accurate measure could use the average speed of cars on a street, represented by the sum of all speeds of all of the cars on the street divided by the number of cars. Another good measurement method of traffic flow is counting the number of cars passing a particular point during a particular time interval. The flow of traffic includes the number of cars and the speed of the cars. A more complex system can incorporate pedestrians and bicyclists on and about the road. Also, just the fact that a route takes an ERV passed a school could be taken into consideration to compensate for the unpredictability of children possibly darting into traffic. Another factor to consider is the actual speed of the traffic on a particular street. If traffic is light on one street, but the average speed is only 20 mph, a street with heavier traffic but traveling at a speed of 40 mph might provide a better alternative. The detection means might include a satellite photography system and analyzer, locally positioned cameras and analyzers, road sensors, radar systems, or a combination thereof. Whatever means are used, the end result of determining the traffic density and speed on a particular street connecting to an intersection is paramount.

Figure 5:
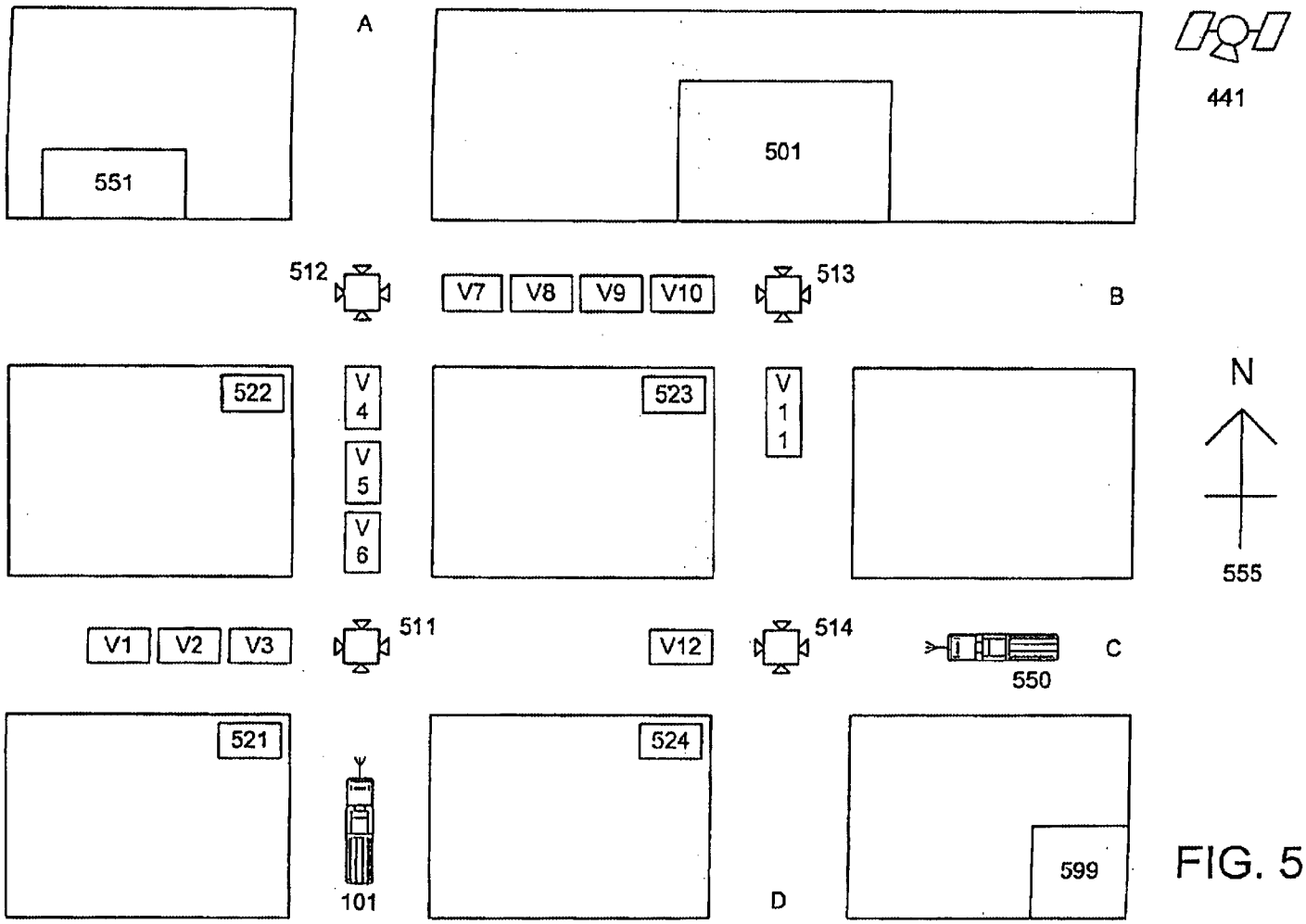
FIG. 5 is a diagram of a typical street map incorporating an embodiment of the present invention.

FIG. 5 is a diagram of a typical street map incorporating an embodiment of the present invention. Shown in FIG. 5 are ERV 101 and ERV 550, GPS 441, streets A–D, traffic lights 511–514, vehicles V1–V12, destination 501 and destination 551. Destinations 501 and 551 might be an accident scene, a hospital, crime scene, etc. Also shown in FIG. 5 are TCMs 521–524, each of which is associated with a respective traffic light 511–514. For ease of description, also shown in FIG. 5 is a compass 555 showing north as up, and throughout the operational description, compass directions will be used with reference to this standard. Intersections will be referenced with respect to the street crossings, i.e., "intersection A/B" relates to that intersection where street A and street B intersect and where traffic light 512 is located. Shown in FIG. 5 is ERV 101; its intended destination is hospital 501 located at intersection B/D. The four traffic lights 511–514 depicted in the figure are located at intersections A/C, A/B, B/D and C/D, respectively. The four TCMs 521–524 are associated with traffic lights 511–514, respectively. Vehicles V1–V3 are located on street C traveling in an easterly direction. Vehicles V4–V6 are located on street A traveling in a northerly direction. Vehicles V7–V10 are located on street B traveling in an easterly direction. Vehicle V11 is on street D traveling north; and vehicle V12 is traveling east on street C. Finally, CPS 599 is also shown.

Figure 6:
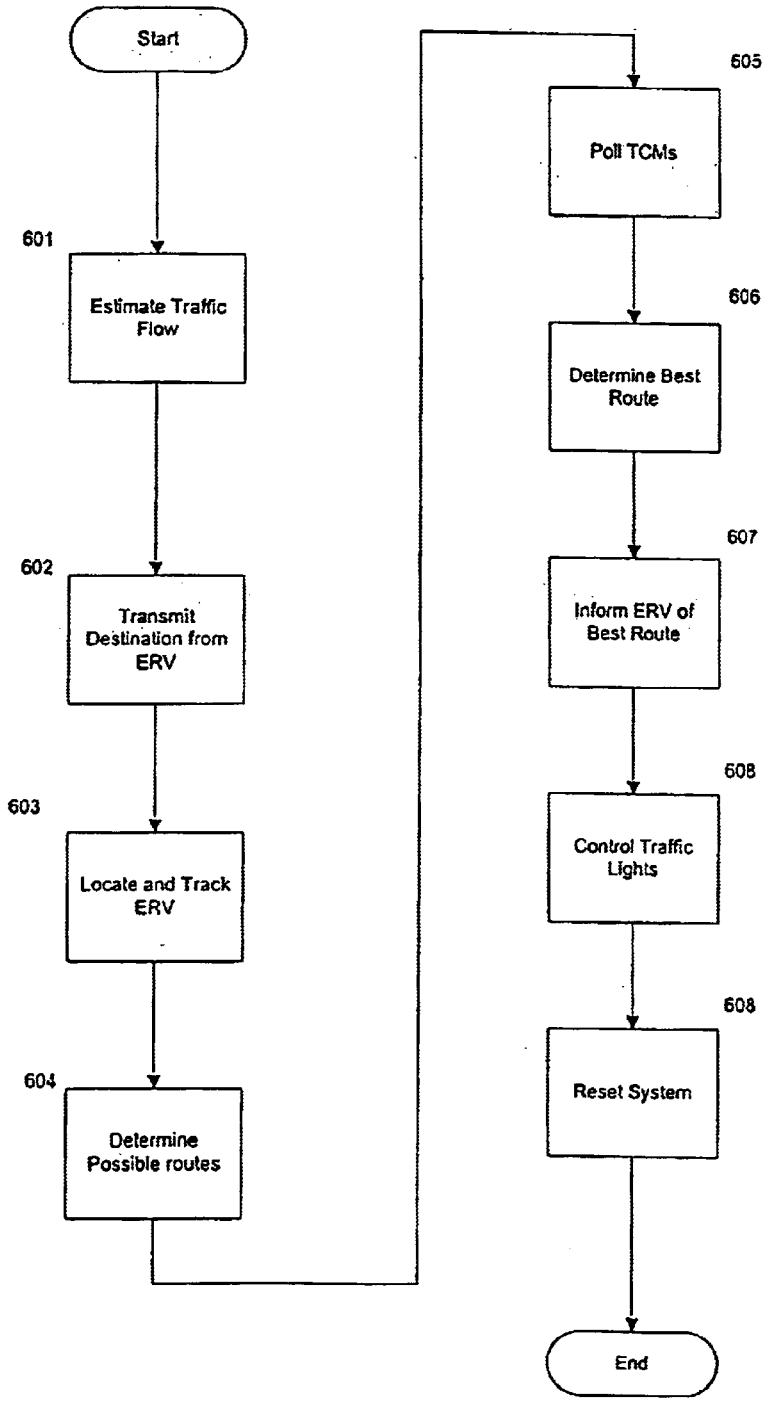
FIG. 6 is a flow chart describing the traffic light control system according to the second embodiment of the present invention.

FIG. 6 is a flow chart describing the traffic light control system according to the second embodiment of the present invention. The operation of the second embodiment will now be described with reference to FIG. 5 and the flow chart of FIG. 6. It is assumed that ERV 101 has been granted access to the bypass logic of TCM 521–524 via an initialization procedure similar to that depicted in FIG. 2. In step 601, traffic detector 451 and traffic control module 422, contained in TCMs 521–524, continuously detect and analyze the traffic flow at their respective intersections and adjoining streets. When an emergency occurs, ERV 101 transmits in step 602 its destination, e.g. hospital 501, to the system. GPS 441 locates and continuously tracks ERV 101 in step 603. In step 604, control unit 115 accesses its map database and determines all possible routes between ERV 101 and destination 501. In the present example and as shown in FIG. 5, two routes exist. Route 1 is to proceed north on street A, turn right at intersection A/B, and east on street B to destination 501. Route 2 is north on street A, turn right at intersection A/C, east on street C, turn left at intersection C/D, and north on street D through intersection B/D to destination 501.

Next in step 605 control unit 115 polls each TCM along each route and receives traffic flow data from the TCMs. In the example depicted in FIG. 5, heavy traffic exists between intersections A/C and A/B, and between intersections A/B and B/D. Light traffic exists between intersections A/C and C/D, and between intersections C/D and B/D. In step 606 control unit 115 using the routing decision module determines the best route for ERV 101 to take to destination 501. With respect to the example depicted in FIG. 5, Route 1 requires one turn, and Route 2 requires two turns. Both routes are about equal in distance. Based on distance and number of turns alone, Route 1 would be the faster route. However, after control unit 115 analyzes the traffic flow data, it determines that Route 2 would be faster, since the traffic flow along Route 2 is less than that along Route 1. In step 607 the TCMs transmit the best route, i.e. Route 2, to ERV 101. In step 608 the system begins to control the traffic lights along Route 2 thus allowing ERV 101 to travel to destination 501 in the shortest amount of time. Finally, after ERV 101 reaches destination 501, ERV 101 sends a system reset signal to the system wherein TCMs 521–524 return to normal operation. In the alternative, the system, as it is tracking ERV 101, can send a reset signal to each TCM as ERV 101 passes through each intersection.

In the previously described embodiments the traffic light control system processed signals from a single ERV. A situation where more than one ERV travel in the same vicinity will now be described. Referring again to FIG. 6, second ERV 550 is shown on street C traveling westbound. ERV 550 is traveling to destination 551. It was determined in the previous example that the best route for ERV 101 to destination 501 was Route 2 (street A to street C to street D). In a manner similar to the previous example, the system determines that the best route for ERV 550 to travel to destination 551 is westbound on street C to northbound on street A to westbound on street B (hereinafter refered to as Route 3). The best route for ERV 550 to destination 551 (i.e. Route 3) will take ERV 551 through intersections C/D, C/A, and A/B. Traffic lights 514, 511 and 512 are along Route 3. ERV 101 and ERV 550 both travel along street C, but in opposite directions, and require ERV 101 and ERV 550 to each travel through intersections A/C and C/I). In addition to the general process of controlling the traffic lights along Route 2 and Route 3, the system determines the proper control of traffic lights 511 and 514 such that both ERVs travel quickly and safely through the two common intersections (i.e. A/C and C/D) and along the common section of street C (i.e. street C between street A and street D).

Several configurations of the system are available to accomplish the traffic light control of the multi ERV situation. In one embodiment, in addition to the TCCs transmitted from each ERV as described earlier, a TCC containing a priority rating descriptive of the level of the emergency each ERV is responding to can be transmitted to the system from each ERV. The priority rating can be preset or user determined. The preset mode can provide the ERV personnel with a menu of possible emergencies. For example, the list could contain "fire", "auto accident", "medical emergency", and associated with each item in the list is a priority rating. When an option is selected, the priority rating associated with that item is transmitted as part of the TCCs. In the user determined mode, the ERV personnel could be provided with an option to select a priority rating, and after selecting a priority rating, the ERV would transmit the selected priority rating to the TCS as part of the TCCs. This priority rating could be used by the system to determine which ERV is given preference while traveling to its destination. The TCMs receive the TCCs (containing the priority ratings) from ERV 101 and ERV 550, and determines that two ERVs are in the same vicinity. If ERV 101 has a higher priority than ERV 550, ERV 101 would be given preference along its best route, that is, the traffic lights along Route 2 would give ERV 101 green lights on traffic lights 511, 514 and 513, while ERV 550 would have a red light on traffic light 514 and 511 but a green light on traffic light 512 along Route 3. The red lights would be changed to green after ERV 101 passes. In the alternative case, if ERV 550 has a higher priority rating the system turns traffic lights 514, 511 and 512 green for ERV 550 along Route 3, and turns traffic lights 511 and 514 red and traffic light 513 green for ERV 101 along Route 2. The red lights would be changed to green after ERV 551 passes. Of course, the system can be linked to CPS 599 to handle the overall control of the traffic lights.

As an alternative to the priority rating system described above, the system can be controlled by a live operator from CPS 599. In this case, the operator would receive priority information from the ERVs, either via TCC signals or through direct voice communication with the personnel of the ERVs and determine which ERV should be given priority and input the priority determination into the system. The system would then control the traffic lights according the input priority.

Variations to the above described embodiments and aspects are certainly contemplated herein. One variation is to provide an operator at CPS 599 with the ability to monitor the traffic on the streets and select the best routes for the ERVs and also give control to the traffic lights to the CPS operator. The varying degrees of operator input, from unmanned system to complete operator control, are contemplated. Also, the system can be so designed to anticipate the arrival of an ERV to an intersection and control the traffic lights at adjacent intersections in such a manner to clear traffic from selected streets to further facilitate the ERV's travel along its best route.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A system for controlling at least one traffic light, the system comprising:

at least one first module having a first transceiver for transmitting and receiving traffic control signals, and having a first control unit for processing said traffic control signals;

at least one second module having a second transceiver for transmitting and receiving said traffic control signals, and having a second control unit for processing said traffic control signals;

a routing decision module for automatically selecting an optimal route between a vehicle and a destination, the vehicle including the first module; and means for controlling at least one traffic light on said selected optimal route in response to said traffic control signals.

2. The system for controlling at least one traffic light of claim 1, wherein said first module is located in at least one vehicle.

3. The system for controlling at least one traffic light of claim 2, wherein said at least one traffic light is controlled via said traffic control signals such that the color of said at least one traffic light is green in a direction of travel of said vehicle to said destination on said selected optimal route.

4. The system for controlling at least one traffic light of claim 3, wherein said routing decision module selects a street route between said vehicle and said destination, and determines an indication of traffic flow on said street route, and an indication of the number and status of traffic lights along said street route.

5. The system for controlling at least one traffic light of claim 3, further comprising:

a global positioning system for determining a location of said vehicle; and means for communicating said position to said routing decision module.

6. The system for controlling at least one traffic light of claim 5, wherein said traffic control signals contain a priority rating for determining a priority of processing said traffic control signals.

7. The system for controlling at least one traffic light of claim 1, wherein said second module is located in at least one traffic control module connected to said at least one traffic light.

8. A system for controlling at least one traffic light, comprising:

at least one vehicle having a transceiver for transmitting and receiving traffic control signals, and a control unit for processing said traffic control signals;

at least one traffic control module having a transceiver for transmitting and receiving said traffic control signals, a control unit for processing said traffic control signals, and logic for controlling at least one traffic light;

a routing decision module for automatically selecting an optimal traffic route between said vehicle and a destination, wherein said traffic control signals control the flow of traffic about said at least one traffic light, said at least one traffic light being located on said selected optimal traffic route, said routing decision module enabling said vehicle to travel from a present location to a destination by traveling on the selected optimal traffic route.

9. The system for controlling at least one traffic light of claim 8, wherein said at least one traffic light is controlled via said traffic control signals such that the color of said at least one traffic light is green in a direction of travel of said vehicle to said destination on said selected optimal traffic route.

10. The system for controlling at least one traffic light of claim 9, wherein said routing decision module selects a street route between said vehicle and said destination, and determines an indication of traffic flow on said street route, and an indication of the number and status of traffic lights along said street route.

11. The system for controlling at least one traffic light of claim 8, further comprising:

a global positioning system for determining a location of said vehicle; and means for communicating said position to said routing decision module.

12. The system for controlling at least one traffic light of claim 11, wherein said traffic control signals contain a priority rating for determining a priority of processing said traffic control signals.

13. A method of controlling at least one traffic light, comprising:

determining a location of a vehicle;

automatically selecting an optimal route from said location to a destination;

transmitting traffic control signals from said vehicle;

controlling at least one traffic light located along the selected optimal route via said control signals to permit passage of said vehicle through said traffic light; and transmitting traffic light control signals from said vehicle to said traffic light after said vehicle passes through said traffic light to release control of said traffic light.

14. The method for controlling at least one traffic light of claim 13, further comprising the steps of:

transmitting a signal from said vehicle indicating a turning direction of said vehicle at an intersection; and controlling said at least one traffic light based on said signal indicating said turning direction of said vehicle.

15. The method for controlling at least one traffic light of claim 13, further comprising the steps of:

setting a timer when said traffic control signals are transmitted from said vehicle;

receiving a confirmation signal from said at least one traffic light confirming receipt of said traffic control signal; and displaying a message at said vehicle if said timer expires prior to receipt of said confirmation.

16. The method for controlling at least one traffic light of claim 13, further comprising:

inputting a destination of said vehicle.

17. The method of claim 16, wherein the location of said vehicle is determined by a global positioning system.

18. The method of claim 16, further comprising the steps of:

determining a number of vehicles located at an intersection traveling on the streets adjoining the intersection;

further selecting said optimal route by including information of the number of vehicles during said selecting of said optimal route.

19. The method for controlling at least one traffic light of claim 18, wherein said traffic control signals contain a priority rating for determining a priority of processing said traffic control signals.

* * * * *